US010823408B2

(12) United States Patent
Kenaya

(10) Patent No.: US 10,823,408 B2
(45) Date of Patent: Nov. 3, 2020

(54) PORTABLE FLAME GENERATING DEVICE

(71) Applicant: Jonathan Kenaya, W Bloomfield, MI (US)

(72) Inventor: Jonathan Kenaya, W Bloomfield, MI (US)

( * ) Notice: Subject to any disclaimer, the term of this patent is extended or adjusted under 35 U.S.C. 154(b) by 13 days.

(21) Appl. No.: 16/105,691

(22) Filed: Aug. 20, 2018

(65) Prior Publication Data

US 2020/0056786 A1 Feb. 20, 2020

(51) Int. Cl.
*F23Q 2/28* (2006.01)
*F23Q 2/40* (2006.01)

(52) U.S. Cl.
CPC ..... *F23Q 2/287* (2013.01); *F23Q 2/40* (2013.01)

(58) Field of Classification Search
CPC ... F23Q 2/16; F23Q 2/28; F23Q 2/287; F23Q 2/40; F23Q 2/25
USPC ..... 431/129–132, 255, 152
See application file for complete search history.

(56) References Cited

U.S. PATENT DOCUMENTS 3,484,178 A 12/1969 Weissmann
4,457,697 A 7/1984 Kitabayashi
4,687,437 A 8/1987 Springer
5,346,392 A 9/1994 Kim
5,348,467 A 9/1994 Piffath
6,234,784 B1 * 5/2001 Yoshinaga ..... F23Q 2/164 431/153
D566,888 S 4/2008 Poinstingl
2002/0110768 A1 * 8/2002 Sher ..... F23Q 2/164 431/153

FOREIGN PATENT DOCUMENTS

WO WO0079184 12/2000

OTHER PUBLICATIONS ("'Cigarette' Shaped Lighter [PIC Heavy]." EDCForums, https://www.edcforums.com/threads/cigarette-shaped-lighter-pic-heavy.91901/. Created Jan. 29, 2012 (Year: 2012).*

* cited by examiner

*Primary Examiner* — Vivek K Shirsat

(57) ABSTRACT

A portable flame generating device for lighting a cigarette includes a tube that is close-ended and configured to position a fuel. A housing, which is coupled to and extends from a top of the tube, is cylindrically shaped, circumferentially equivalent to the tube, and comprises an upper section that is pivotally coupled to a lower section. A nozzle is coupled to the top of the tube and is in fluidic communication with the tube. The nozzle extends through the housing to proximate to an upper end of the housing. A piezoelectric igniter is coupled and positioned in the housing. The nozzle and the piezoelectric igniter are operationally coupled to the upper section of the housing. The upper section is configured to be pivoted relative to the lower section to fluidically couple the nozzle to the tube and to actuate the piezoelectric igniter to ignite the fuel flowing from the nozzle.

11 Claims, 4 Drawing Sheets

PORTABLE FLAME GENERATING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to flame generating devices and more particularly pertains to a new flame generating device for lighting a cigarette.

BRIEF SUMMARY OF THE INVENTION

An embodiment of the disclosure meets the needs presented above by generally comprising a tube that is close-ended and configured to position a fuel. A housing, which is coupled to and extends from a top of the tube, is cylindrically shaped, circumferentially equivalent to the tube, and comprises an upper section that is pivotally coupled to a lower section. A nozzle is coupled to the top of the tube and is in fluidic communication with the tube. The nozzle extends through the housing to proximate to an upper end of the housing. A piezoelectric igniter is coupled and positioned in the housing. The nozzle and the piezoelectric igniter are operationally coupled to the upper section of the housing. The upper section is configured to be pivoted relative to the lower section to fluidically couple the nozzle to the tube and to actuate the piezoelectric igniter to ignite the fuel flowing from the nozzle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
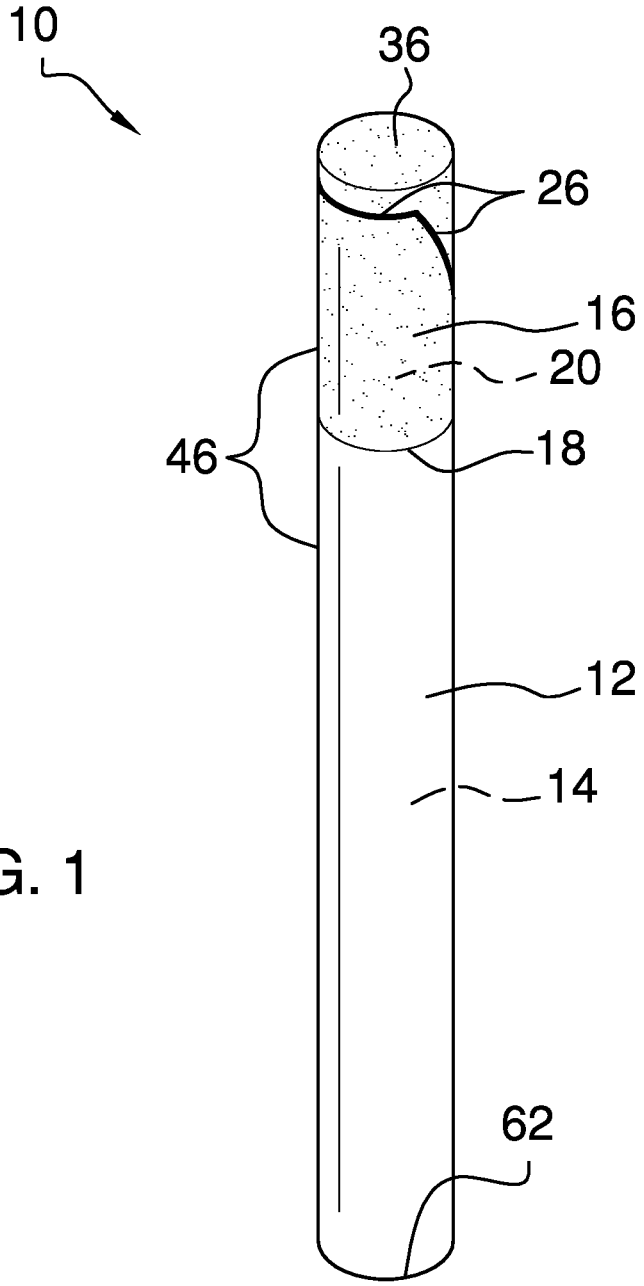
FIG. 1 is an isometric perspective view of a portable flame generating device according to an embodiment of the disclosure.
Figure 2:
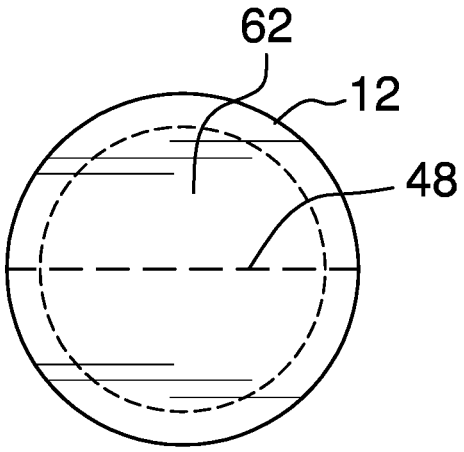
FIG. 2 is a bottom view of an embodiment of the disclosure.
Figure 3:
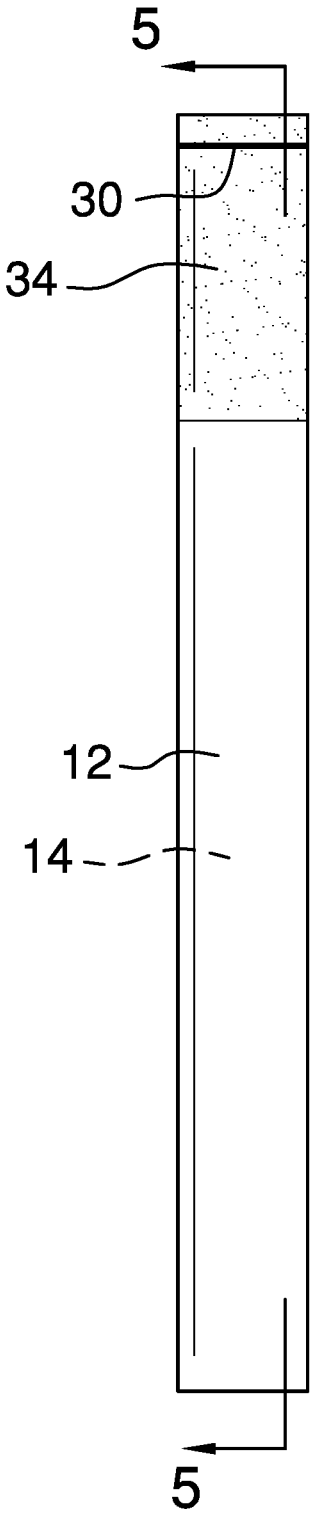
FIG. 3 is a front view of an embodiment of the disclosure.
Figure 4:
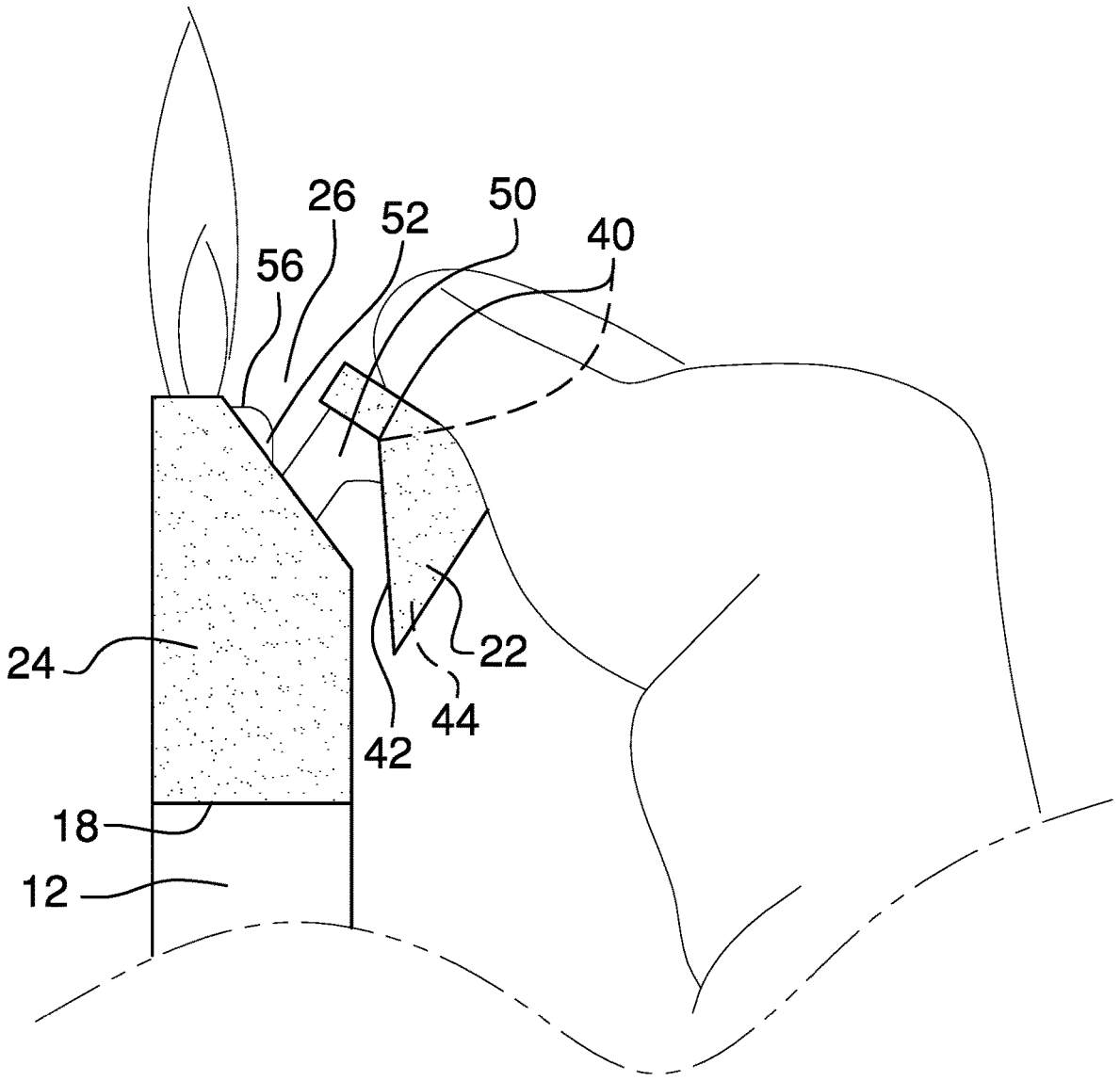
FIG. 4 is an in-use view of an embodiment of the disclosure.
Figure 5:
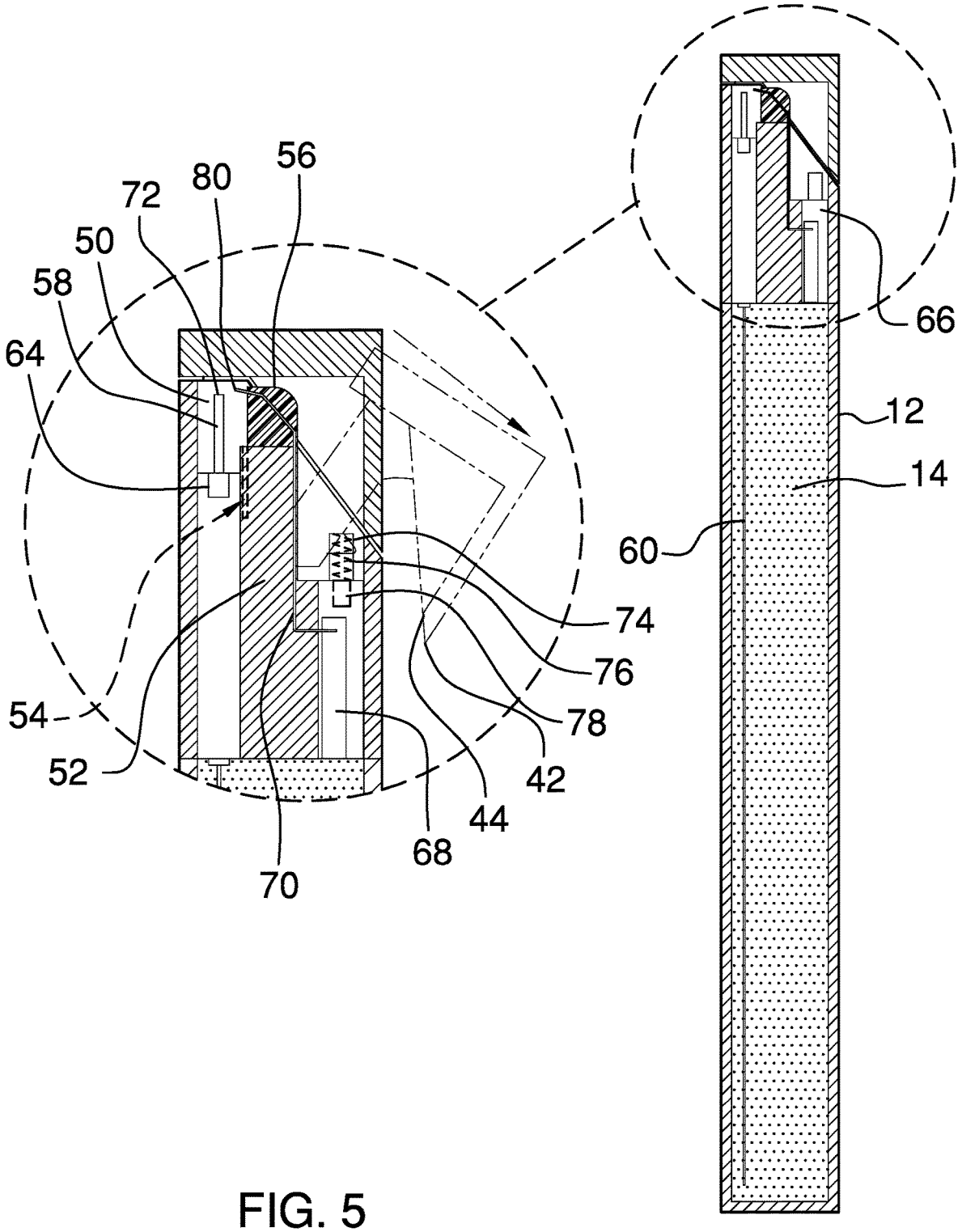
FIG. 5 is a cross-sectional view of an embodiment of the disclosure.

With reference now to the drawings, and in particular to FIGS. 1 through 5 thereof, a new flame generating device embodying the principles and concepts of an embodiment of the disclosure and generally designated by the reference numeral 10 will be described.

As best illustrated in FIGS. 1 through 5, the portable flame generating device 10 generally comprises a tube 12 that is close-ended and configured to position a fuel 14, such as butane. The tube 12 is colored so that the tube 12 mimics an appearance of cigarette paper.

A housing 16 is coupled to and extends from a top 18 of the tube 12. The housing 16 defines an interior space 20. The housing 16 is cylindrically shaped and is circumferentially equivalent to the tube 12. The housing 16 is colored so that the housing 16 mimics an appearance of a filter of a cigarette.

The housing 16 comprises an upper section 22 that is pivotally coupled to a lower section 24. The upper section 22 is defined by a slit 26 that is positioned in a sidewall 28 of the housing 16. The slit 26 comprises a first section 30 and a second section 32. The first section 30 is positioned in a front 34 of the housing 16 and extends in parallel to an upper end 36 of the housing 16 toward a back 38 of the housing 16. The second section 32 extends between opposing ends 40 of the first section 30. The second section 32 extends transversely toward the back 38 of the housing 16 and the top 18 of the tube 12.

The second section 32 of the slit 26 extends transversely through the sidewall 28 toward the upper end 36 of the housing 16 so that an outer perimeter 42 of the second section 32 is closer to the top 18 of the tube 12 than an inner perimeter 44 of the second section 32. Effectively, the second section 32 of the slit 26 is tapered so that the upper section 22 of the housing 16 is positioned to pivot relative to the lower section 24.

The housing 16 and the tube 12 have a combined length 46 of between 70 and 140 millimeters. The tube 12 has a diameter 48 between 5 and 10 millimeters. The housing 16 and the tube 12 together have a combined length 46 selected from the group of combined lengths 46 consisting of 70 millimeters, 84 millimeters, 100 millimeters, and 120 millimeters, corresponding to a length of a regular, a king, a "100", and a "120" cigarette, respectively. The tube 12 has a diameter 48 selected from the group of diameters 48 consisting of 5, 6, 7, and 8 millimeters, corresponding to the typical diameters of cigarettes. A device 10 having a respective combined length 46 and respective diameter 48 is directly insertable into a pack of cigarettes in place of a cigarette of the same length and diameter.

An arm 50 is coupled to the upper section 22 of the housing 16. The arm 50 extends into the interior space 20 proximate to the front 34 of the housing 16. A wall 52 is coupled to the housing 16 and positioned in the interior space 20. The wall 52 extends perpendicularly from the top 18 of the tube 12 toward the upper end 36 of the housing 16. A slot 54 extends into an upper limit 56 of the wall 52 toward the top 18 of the tube 12. The arm 50 is positioned in the slot 54 and is pivotally coupled to the wall 52. The tube 12 is configured to be grasped in digits of a hand of a user positioning a thumb of the hand to pivot the upper section 22 of the housing 16 relative to the lower section 24.

A nozzle 58 is coupled to the top 18 of the tube 12 so that the nozzle 58 is in fluidic communication with the tube 12. The nozzle 58 extends through the interior space 20 to proximate to the upper end 36 of the housing 16. The nozzle 58 is positioned proximate to the front 34 of the housing 16. The nozzle 58 is operationally coupled to the upper section 22 of the housing 16. The upper section 22 is configured to be selectively pivoted relative to the lower section 24 to fluidically couple the nozzle 58 to the tube 12.

A hose 60 is coupled to the top 18 of the tube 12 and extends from the nozzle 58 to proximate to a bottom 62 of the tube 12. Vapor from the fuel 14 positioned in the tube 12 pressurizes the tube 12 so that the hose 60 is positioned for fuel 14 to flow from the tube 12 to the nozzle 58.

A valve 64 is operationally coupled to and positioned between the nozzle 58 and the tube 12. The valve 64 is operationally coupled to the upper section 22 of the housing 16. The upper section 22 is configured to be selectively pivoted relative to the lower section 24 to selectively actuate the valve 64 to fluidically couple the nozzle 58 to the tube 12.

A piezoelectric igniter 66 is coupled to the housing 16 and positioned in the interior space 20. The piezoelectric igniter 66 is operationally coupled to the upper section 22 of the housing 16. The upper section 22 is configured to be selectively pivoted relative to the lower section 24 to actuate the piezoelectric igniter 66 to ignite the fuel 14 that flows from the nozzle 58.

The piezoelectric igniter 66 comprises a crystal 68 that is positioned in the housing 16 between the wall 52 and the back 38 of the housing 16. The crystal 68 comprises a material, such as quartz or lead zirconate titanate, that accumulates an electrical charge in response to an applied mechanical stress. A wire 70 is coupled to the crystal 68 and extends to proximate to the nozzle 58. A terminus 80 of the wire 70 is positioned proximate to an opening 72 of the nozzle 58.

A cylinder 74 is coupled to the housing 16 and positioned in the interior space 20 proximate to the crystal 68. The cylinder 74 is hollow and open-bottomed. A spring 76 is coupled to and positioned in the cylinder 74. The spring 76 is operationally coupled to the upper section 22 of the housing 16. A hammer 78 is coupled to the spring 76 and is selectively extensible from the cylinder 74. The spring 76 is positioned to be tensioned as the second section 32 of the housing 16 is pivoted relative to the first section 30. The spring 76 is positioned to rebound when the second section 32 is fully pivoted so that the hammer 78 is propelled from the cylinder 74 to strike the crystal 68. The hammer 78 striking the crystal 68 generates a voltage, positioning the wire 70 to direct an electrical discharge from the crystal 68 to create a spark proximate to the opening 72 of the nozzle 58 to ignite the fuel 14 from the tube 12. A typical use of the device 10 would be to light a cigarette.

In use, the tube 12 is grasped in the digits of the hand of the user. The thumb of the hand is used to pivot the upper section 22 of the housing 16 relative to the lower section 24 to fluidically couple the nozzle 58 to the tube 12 and to actuate the piezoelectric igniter 66 to ignite the fuel 14 flowing from the nozzle 58, positioning the user to light a cigarette.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A portable flame generating device comprising:

a tube, the tube being close-ended wherein the tube is configured for positioning a fuel;

a housing coupled to and extending from a top of the tube, the housing defining an interior space, the housing being cylindrically shaped, an outer surface of the housing being aligned with an outward surface of the tube, the housing comprising an upper section pivotally coupled to a lower section;

a nozzle coupled to the top of the tube such that the nozzle is in fluidic communication with the tube, the nozzle extending through the interior space to proximate to an upper end of the housing, the nozzle being operationally coupled to the upper section of the housing wherein the upper section is configured for selectively pivoting relative to the lower section for fluidically coupling the nozzle to the tube;

a piezoelectric igniter coupled to the housing and positioned in the interior space, the piezoelectric igniter being operationally coupled to the upper section of the housing wherein the upper section is configured for selectively pivoting relative to the lower section for actuating the piezoelectric igniter for igniting the fuel flowing from the nozzle;

an arm coupled to the upper section of the housing, the arm extending into the interior space proximate to a front of the housing;

a wall coupled to the housing and positioned in the interior space, the wall extending perpendicularly from the top of the tube toward the upper end of the housing; and a slot extending into an upper limit of the wall toward the top of the tube, the arm being positioned in the slot and pivotally coupled to the wall wherein the tube is configured for grasping in digits of a hand of a user positioning a thumb of the hand for pivoting the upper section of the housing relative to the lower section.

2. The device of claim 1, further comprising:

the tube being colored such that the tube mimics an appearance of cigarette paper; and the housing being colored such that the housing mimics an appearance of a filter of a cigarette.

3. The device of claim 1, further including the upper section being defined by a slit positioned in a sidewall of the housing, the slit comprising a first section and a second section, the first section being positioned in a front of the housing and extending in parallel to the upper end of the housing toward a back of the housing, the second section extending between opposing ends of the first section, the second section extending transversely toward the back of the housing and the top of the tube, the second section of the slit extending transversely through the sidewall toward the upper end of the housing such that an outer perimeter of the second section is closer to the top of the tube than an inner perimeter of the second section.

4. The device of claim 1, further comprising:

the housing and the tube together having a length between 70 and 140 millimeters; and the tube having a diameter between 5 and 10 millimeters.

5. The device of claim 4, further comprising:

the housing and the tube together having a length selected from the group of lengths consisting of 70 millimeters, 84 millimeters, 100 millimeters, and 120 millimeters; and the tube having a diameter selected from the group of diameters consisting of 5, 6, 7, and 8 millimeters.

6. The device of claim 1, further including the nozzle being positioned proximate to a front of the housing.

7. The device of claim 1, further including a hose coupled to the top of the tube and extending from the nozzle to proximate to a bottom of the tube wherein vapor from the fuel positioned in the tube pressurizes the tube such that the hose is positioned for flowing of the fuel from the tube to the nozzle.

8. The device of claim 1, further including a valve operationally coupled to and positioned between the nozzle and the tube, the valve being operationally coupled to the upper section of the housing wherein the upper section is configured for selectively pivoting relative to the lower section for selectively actuating the valve for fluidically coupling the nozzle to the tube.

9. The device of claim 1, further including the piezoelectric igniter comprising:

a crystal positioned in the housing between the wall and the back of the housing, the crystal comprising a material that accumulates an electrical charge in response to an applied mechanical stress;

a wire coupled to the crystal and extending to proximate to the nozzle wherein a terminus of the wire is positioned proximate to an opening of the nozzle;

a cylinder coupled to the housing and positioned in the interior space proximate to the crystal, the cylinder being hollow and open-bottomed;

a spring coupled to and positioned in the cylinder, the spring being operationally coupled to the upper section of the housing; and a hammer coupled to the spring and selectively extensible from the cylinder wherein the spring is positioned for tensioning as the second section of the housing is pivoted relative to the first section and for rebounding when the second section is fully pivoted such that the hammer is propelled from the cylinder for striking the crystal for generating a voltage positioning the wire for directing an electrical discharge from the crystal for creating a spark proximate to the opening of the nozzle for igniting the fuel from the tube.

10. A portable flame generating device comprising:

a tube, the tube being close-ended wherein the tube is configured for positioning a fuel, the tube being colored such that the tube mimics an appearance of cigarette paper;

a housing coupled to and extending from a top of the tube, the housing defining an interior space, the housing being cylindrically shaped, an outer surface of the housing being aligned with an outward surface of the tube, the housing comprising an upper section pivotally coupled to a lower section, the upper section being defined by a slit positioned in a sidewall of the housing, the slit comprising a first section and a second section, the first section being positioned in a front of the housing and extending in parallel to an upper end of the housing toward a back of the housing, the second section extending between opposing ends of the first section, the second section extending transversely toward the back of the housing and the top of the tube, the second section of the slit extending transversely through the sidewall toward the upper end of the housing such that an outer perimeter of the second section is closer to the top of the tube than an inner perimeter of the second section, the housing being colored such that the housing mimics an appearance of a filter of a cigarette, the housing and the tube together having a length between 70 and 140 millimeters, the tube having a diameter between 5 and 10 millimeters;

an arm coupled to the upper section of the housing, the arm extending into the interior space proximate to the front of the housing;

a wall coupled to the housing and positioned in the interior space, the wall extending perpendicularly from the top of the tube toward the upper end of the housing;

a slot extending into an upper limit of the wall toward the top of the tube, the arm being positioned in the slot and pivotally coupled to the wall wherein the tube is configured for grasping in digits of a hand of a user positioning a thumb of the hand for pivoting the upper section of the housing relative to the lower section;

a nozzle coupled to the top of the tube such that the nozzle is in fluidic communication with the tube, the nozzle extending through the interior space to proximate to the upper end of the housing, the nozzle being operationally coupled to the upper section of the housing wherein the upper section is configured for selectively pivoting relative to the lower section for fluidically coupling the nozzle to the tube, the nozzle being positioned proximate to the front of the housing;

a hose coupled to the top of the tube and extending from the nozzle to proximate to a bottom of the tube wherein vapor from the fuel positioned in the tube pressurizes the tube such that the hose is positioned for flowing of the fuel from the tube to the nozzle;

a valve operationally coupled to and positioned between the nozzle and the tube, the valve being operationally coupled to the upper section of the housing wherein the upper section is configured for selectively pivoting relative to the lower section for selectively actuating the valve for fluidically coupling the nozzle to the tube; and a piezoelectric igniter coupled to the housing and positioned in the interior space, the piezoelectric igniter being operationally coupled to the upper section of the housing wherein the upper section is configured for selectively pivoting relative to the lower section for actuating the piezoelectric igniter for igniting the fuel flowing from the nozzle, the piezoelectric igniter comprising:

a crystal positioned in the housing between the wall and the back of the housing, the crystal comprising a material that accumulates an electrical charge in response to an applied mechanical stress, a wire coupled to the crystal and extending to proximate to the nozzle wherein a terminus of the wire is positioned proximate to an opening of the nozzle, a cylinder coupled to the housing and positioned in the interior space proximate to the crystal, the cylinder being hollow and open- bottomed, a spring coupled to and positioned in the cylinder, the spring being operationally coupled to the upper section of the housing, and a hammer coupled to the spring and selectively extensible from the cylinder wherein the spring is positioned for tensioning as the second section of the housing is pivoted relative to the first section and for rebounding when the second section is fully pivoted such that the hammer is propelled from the cylinder for striking the crystal for generating a voltage positioning the wire for directing an electrical discharge from the crystal for creating a spark proximate to the opening of the nozzle for igniting the fuel from the tube.

11. The device of claim 10, further including the housing and the tube together having a length selected from the group of lengths consisting of 70 millimeters, 84 millimeters, 100 millimeters, and 120 millimeters, the tube having a diameter selected from the group of diameters consisting of 5, 6, 7, and 8 millimeters.

* * * * *